US006141629A

United States Patent [19]

Yamamoto et al.

[11] Patent Number: 6,141,629

[45] Date of Patent: Oct. 31, 2000

[54] METHOD AND APPARATUS FOR DETERMINING MACHINE MAINTENANCE DUE TIMES

[75] Inventors: Shigeru Yamamoto; Kunihiko Imanishi, both of Hirakata; Takao Nagai, Saitama; Sadachika Akiyama, Yuki; Jiro Akagi, Oyama; Nobuki Hasegawa, Tokyo; Kazunori Kuromoto, Yokohama; Taku Murakami, Yamato, all of Japan

[73] Assignee: Komatsu Ltd., Tokyo, Japan

[21] Appl. No.: 09/114,566

[22] Filed: Jul. 13, 1998

[30] Foreign Application Priority Data

Jul. 16, 1997 [JP] Japan ..... 9-191349

[51] Int. Cl.[7] ..... G06F 17/40

[52] U.S. Cl. ..... 702/187; 702/177; 702/182; 702/184; 701/29; 701/30; 701/31; 701/35; 340/309.15; 340/439; 340/457.4

[58] Field of Search ..... 702/177, 182–186, 702/187; 701/29, 30, 31, 35; 340/457.4, 309.15, 439

[56] References Cited

U.S. PATENT DOCUMENTS 4,539,632 9/1985 Hansen et al. ..... 700/14
4,630,027 12/1986 Muhlberger et al. ..... 340/457.4
4,884,054 11/1989 Moon, Sr. ..... 340/309.15
5,581,486 12/1996 Terada et al. ..... 702/177

*Primary Examiner*—Marc S. Hoff
*Assistant Examiner*—Hein Vo
*Attorney, Agent, or Firm*—Welsh & Katz, Ltd.

[57] ABSTRACT

Maintenance due times of components of a machine are determined according to the status of user-performed in-house maintenance and according to the occurrence of abnormalities during machine operation. A subtraction point (20 points) associated with an abnormality (overheating) detected during machine operation is subtracted from the score (80 points) of a corresponding component (engine) in the machine. An addition point (50 points) associated with the type of maintenance (overhaul performed by in-house maintenance) indicated in maintenance information is added to the score (80 points). Thus, at the time where the value resulting from subtractions from and additions to the score for that component (engine) reaches a prescribed value (10 points) indicating maintenance due time, it is determined that the maintenance due time for that component (engine) has been reached.

8 Claims, 11 Drawing Sheets

FIG.13

VEHICLE COMPONENT TABLE

| COMPONENT | ID NUMBER | BASIC SCORE | |
|---|---|---|---|
| ENGINE | #25 | 80 | |
| T/M | #107 | 85 | |
| PUMP | #201 | 70 | |
| | | | |

FIG.14

SUBTRACTION POINT TABLE

| ABNORMALITY / COMPONENT | OVERHEATING | OIL PRESSURE DROP | OVERLOADING | |
|---|---|---|---|---|
| ENGINE | −20 | −10 | −50 | |
| T/M | | | | |
| PUMP | | | | |
| | | | | |

FIG.15

ADDITION POINT TABLE

| MAINTENANCE OPERATION / COMPONENT | OVERHAUL | PISTON REPLACEMENT | ENGINE OIL FILTER CHANGE | |
|---|---|---|---|---|
| ENGINE | +50 | +10 | +5 | |
| T/M | | | | |
| PUMP | | | | |
| | | | | |

METHOD AND APPARATUS FOR DETERMINING MACHINE MAINTENANCE DUE TIMES

BACKGROUND OF THE INVENTION

1. Field of the Invention

This invention relates to a method and apparatus for determining maintenance due times for construction machines and other machines based on the operating status thereof.

2. Description of the Related Art

There are inventions concerning the determination of maintenance due times for construction machines and other machines based on the operating status thereof, such as is disclosed in Unexamined Japanese Patent Publication no. 6-116988.

This publicly disclosed invention is such that, together with measuring the operating time of a construction machine with an hour meter, it also makes corrections in the operating time according to two types of work performed by the construction machine (namely standard work and heavy work), and then determines that it has become the maintenance due time of the construction machine when the corrected operating time has arrived at a predetermined maintenance due time established for each component of the construction machine.

With the conventional technology noted above, the maintenance due time is determined on the basis only of the operating time.

In actual practice, however, there are great discrepancies in maintenance due times between the cases where in-house maintenance, such as replacing or overhauling its components is done thoroughly and the cases where it is not done at all. Moreover, with the conventional technology, although operating time is corrected according to the nature of the work performed by the construction machine, no consideration whatever is made for the effects of such abnormalities as overheating that occurred during the operation of the construction machine. In actual practice, when an abnormality such as overheating does occur during the operation of a construction machine, the maintenance due time will be very different than in the case where no such abnormality occurs.

Accordingly, in the conventional technology, it will be determined at an improperly early stage that the maintenance due time has been reached even in the situation where thorough in-house maintenance is being performed and maintenance such as an overhaul does not need to be performed yet. As a result, users are obliged to perform unnecessary maintenance. Conversely, with the conventional technology, when an abnormality such as overheating occurs, and it really is time to perform an overhaul or other maintenance, it will nevertheless be determined that it is time for maintenance later than the fact, so needed maintenance will be delayed. This inevitably results in serious damage done to the construction machine.

In general, moreover, in the case of construction machines, when the time for overhaul maintenance is reached, components such as engines are replaced with standby components (spare components).

This presents difficulties, however, in that it then becomes impossible to determine when the next maintenance due time (overhaul time) should be after the standby component has been installed.

SUMMARY OF THE INVENTION

A first object of the present invention, which has been devised in view of the circumstances set forth in the foregoing, is to provide a method and an apparatus for determining maintenance due times for construction machines and other machines capable of determining appropriate maintenance due times in consideration of the in-house maintenance performed by the user and in consideration of abnormalities that have occurred during machine operations.

A second object of the present invention is to provide a method and an apparatus for determining maintenance due times for construction machines and other machines capable of determining the next maintenance due time with continuity, even when a component of the machine has been replaced.

In order to attain the first object noted above, a first aspect of the present invention provides a method of determining maintenance due times for a machine on the basis of the operating status, comprising the steps of giving a score according to reserve time remaining until next maintenance due time to each component of the machine; associating a point to be subtracted from a score of each the component of the machine, for every type of abnormal phenomenon that could occur while the machine is operating, and for associating a point to be added to the score of each the component of the machine for every type of maintenance that would be performed on the machine; detecting abnormal phenomena that occurred while the machine is operating, and inputting information on maintenance that was performed on the machine; subtracting a subtraction point associated with the detected abnormal phenomena from the score of the corresponding component of the machine, and for adding an addition point associated with maintenance type indicated by the maintenance information to the score of the corresponding component of the machine; and determining that the maintenance due time for the component has been reached when value resulting from subtraction from or addition to the score for the component of the machine attains a prescribed value.

With this configuration, as indicated in tables shown in FIGS. 13, 14, and 15, for a component (engine) in the machine, a subtraction point (−20 points) associated with an abnormal phenomenon (overheating) detected while the machine is operating, is subtracted from the score (80 points) of the component (engine). An addition point (+50 points) associated with a maintenance type (in-house overhaul) indicated in the input maintenance information is added to the score (80 points) of the component (engine). Thus it is determined that a maintenance due time for the component (engine) has been reached at the time where the value resulting from the subtraction from or addition to the score of the component (engine) of the machine has attained the prescribed value (10 points, for example) that indicates the maintenance due time.

It thus becomes possible to determine appropriate maintenance due times depending both on the in-house maintenance practices of the user and on any abnormalities that occur while the machine is operating.

The first invention, therefore, is beneficial in that a user can avoid to perform unnecessary maintenance work due to the fact that maintenance due times are determined too early, and the machinery can avoid serious damage due to the fact that the maintenance due time is determined too late.

In order to realize the second object noted above, a second aspect of the present invention, in addition to the configuration of the first aspect of the invention described above, is configured such that an identification code that specifies a component of the machine is given to each component of the machine, and each identification code is associated with the score, subtraction point when abnormalities have occurred and addition point when maintenance has been performed.

With this configuration, when a maintenance due time has been reached, even if a component such as an engine in the construction machine has been replaced with a standby component, an identification code is given to that standby component, and score, subtraction points generated by abnormal phenomena, and addition points resulting from maintenance work being performed are associated with that identification code. Thus, the next maintenance due time (overhaul time) is determined appropriately after the standby component has been installed, in the same way as before the replacement.

Thus, as based on the second aspect of the invention, in addition to the benefits of the first aspect of the invention, further benefits are realized in that, even when components of the machine have been replaced, the next maintenance due time can be suitably determined with continuity.

BRIEF DESCRIPTION OF THE DRAWINGS

FIG. 13 is a table for components installed in a vehicle and ID numbers and basic scores given to them;

FIG. 14 is a subtraction point table showing subtraction points for abnormalities for each component;

FIG. 15 is an addition point table showing addition points for maintenances for each component;

DESCRIPTION OF THE PREFERRED EMBODIMENT

Embodiment of a method and an apparatus for determining machine maintenance due times of the present invention are now described, making reference to the drawings.

To begin with, a method of monitoring the abnormalities that may occur while a machine is operating, upon which method the present invention is premised, is described.

In the embodiment, it is assumed that the machine is a construction machine, and overhaul time and life of the construction machine are managed and monitored. The present invention, nevertheless, can be applied as well to other machines beside construction machines.

A monitoring system for used in the monitoring method is configured as described below.

Specifically, sensors are installed in various places in the construction machine such as hydraulic shovel, etc. for detecting various kinds of operating parameters, the values of which change successively while the construction machine is operating, such operating parameters being engine power (engine output), engine rotational speed, torque, loads applying various working tools, strokes in hydraulic cylinders of the various working tools, pressures in hydraulic drive lines, engine blow-by pressure, and governor rack position, etc.

Normally, sensors (such as an engine rpm sensor) are installed in the construction machine to obtain feedback signals for driving and controlling the construction machine. Those existing sensors may be used without modification, and without installing new sensors for the monitoring purposes. If the operating parameter is one (such as blow-by pressure) which is not normally used in driving and controlling the construction machine, then it is necessary to install a new sensor for detecting that operating parameter.

The detection signals output from those sensors are input to a monitoring controller configured around a CPU, processing yet to be described is executed by this controller, and the results of that processing are displayed on a display device which is installed at a position for the operator to watch them. Alternatively, as will be described below while referring to FIG. 12, the controller installed at the construction machine may be connected with a personal computer 21 external to the construction machine, by prescribed communication means, so that the processing results from the controller can be monitored at an external location (monitoring station 20).

Figure 1:
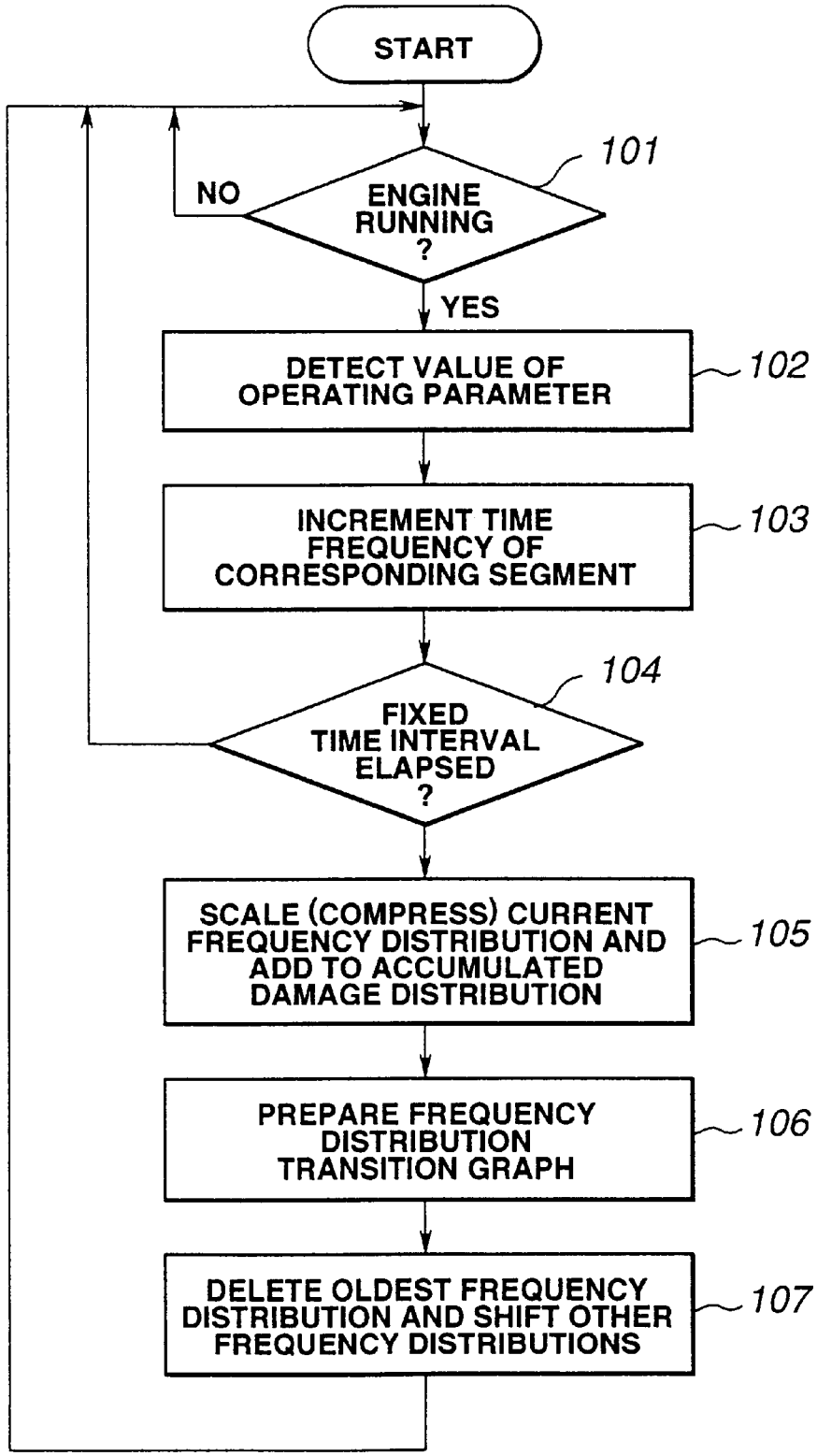
FIG. 1 is a flowchart illustrating a processing routine for monitoring machine abnormalities.

FIG. 1 is a flowchart which illustrates processing procedures that are executed by the controller.

Referring to FIG. 1, in step 101, whether or not the engine is operating is determined based on the output from the engine rotational speed sensor. More specifically, whether or not the engine is turning at a speed of 1500 rpm or higher is determined. This determination in step 101 is performed to determine whether or not the construction machine is operating, and is a requirement for the processing that is performed in the following steps 102 through 107. Therefore, the particulars of the determination in step 101 may be altered according to the purpose of the processing performed in the steps 102 through 107, described below. For example, instead of determining as to whether or not the engine is rotating, determination may be made as to whether or not the machine is advancing, or as to whether or not the machine is working.

Next, when it is determined that the construction machine is operating, values for combinations (sets) of various kinds of operating parameters that change successively are detected.

Combination of the operating parameters is a combination of mutually associated operating parameters, which comprise a main parameter and subordinate parameters that depend on the main parameter.

Examples of such combinations (sets) are listed below.

(1) Engine rotational speed and torque (2) Load imposed on a working tool and amount of stroke in hydraulic cylinder for that working tool (3) Pressure in a hydraulic drive line and engine rotational speed (4) Engine blow-by pressure, engine rotational speed, and governor rack position In the combination (4), for example, blow-by pressure is the main parameter, while engine rotational speed and rack position are subordinate parameters dependent on the main parameter.

Alternatively, a single operating parameter may be made the object of detection, such as:

(5) Engine power (engine output)

A value or combinations of values, which are either a value of a single operating parameter or combinations of values of two or more operating parameters, are divided beforehand into a plurality of levels (each of which is hereinafter called a segment SG). The result of the division into these segments SG is called a frequency map.

Figure 2:
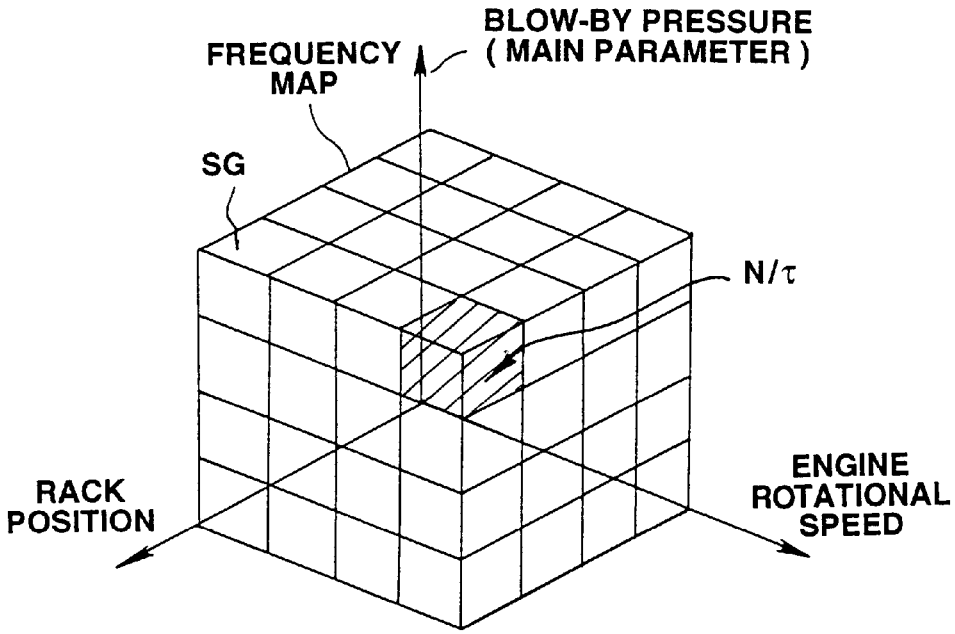
FIG. 2 is a diagram illustrating a three-dimensional frequency map for operating parameters.

More specifically, in the combination (4), namely the combination of engine blow-by pressure, engine rotational speed and governor rack position, the combination of these values is pre-divided into three-dimensional segments SG as shown in FIG. 2, configuring a three-dimensional frequency map.

Figure 9:
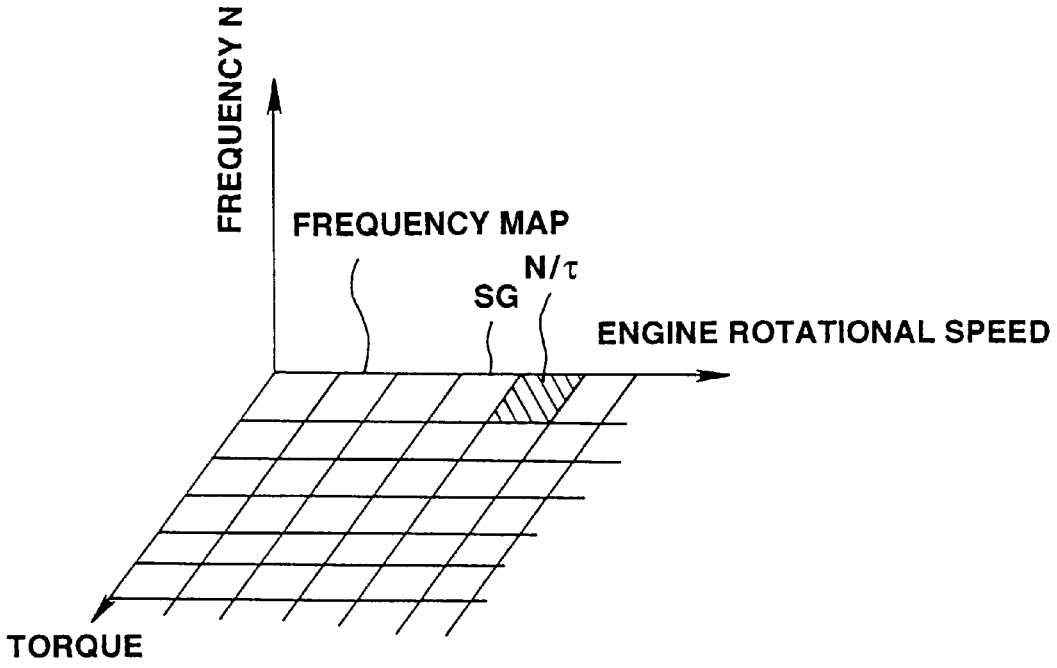
FIG. 9 is a diagram illustrating a one-dimensional frequency map for operating parameters.

In the combination (1), namely the combination of engine rotational speed and torque, the combination of these values is pre-divided into two-dimensional segments SG, as shown in FIG. 9, configuring a two-dimensional frequency map.

Figure 5:
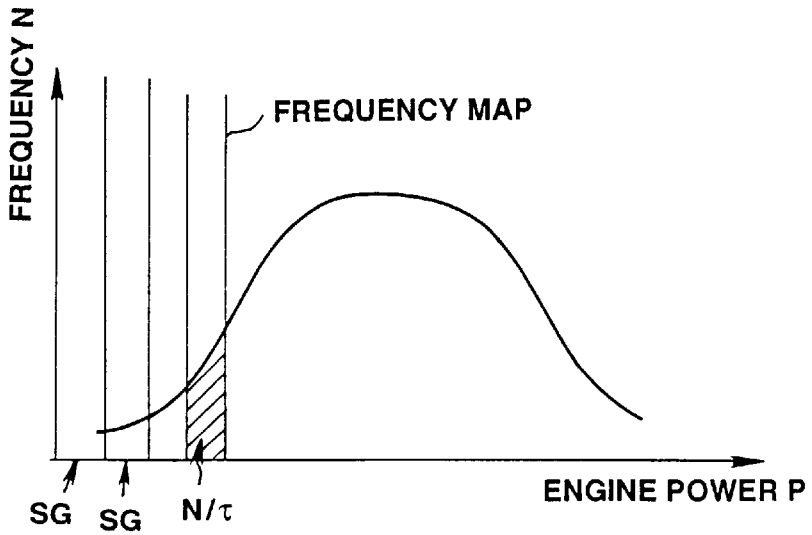
FIG. 5 is a diagram illustrating a two-dimensional frequency map for operating parameters.

In the case of (5), namely a single operating parameter, engine power, this value is divided into one-dimensional segments SG, as shown in FIG. 5, configuring a one-dimensional frequency map.

When one or more operating parameters have been detected by sensors, a decision is made as to which frequency map segment SG the value of the single detected operating parameter or the combination of values for two or more detected operating parameters belongs to.

For a single operating parameter (e.g., engine power) which is to be detected, a decision is made as to which of the several segment SG levels in the one-dimensional frequency map diagrammed in FIG. 5 the detected value of the engine power falls in. For the combination of two or more operating parameters (e.g., engine blow-by pressure, engine rotational speed and governor rack position) which are to be detected, a decision is made as to which of the segment SG levels in the three-dimensional frequency map diagrammed in FIG. 2 the combination of the detected values for the blow-by pressure, engine rotational speed, and rack position falls in.

In each segment SG is stored a detection frequency N.

To facilitate the explanation, a description is given for the case which involves a single operating parameter (engine power). The same holds true for cases involving a combination of two or more operating parameters.

Figure 4:
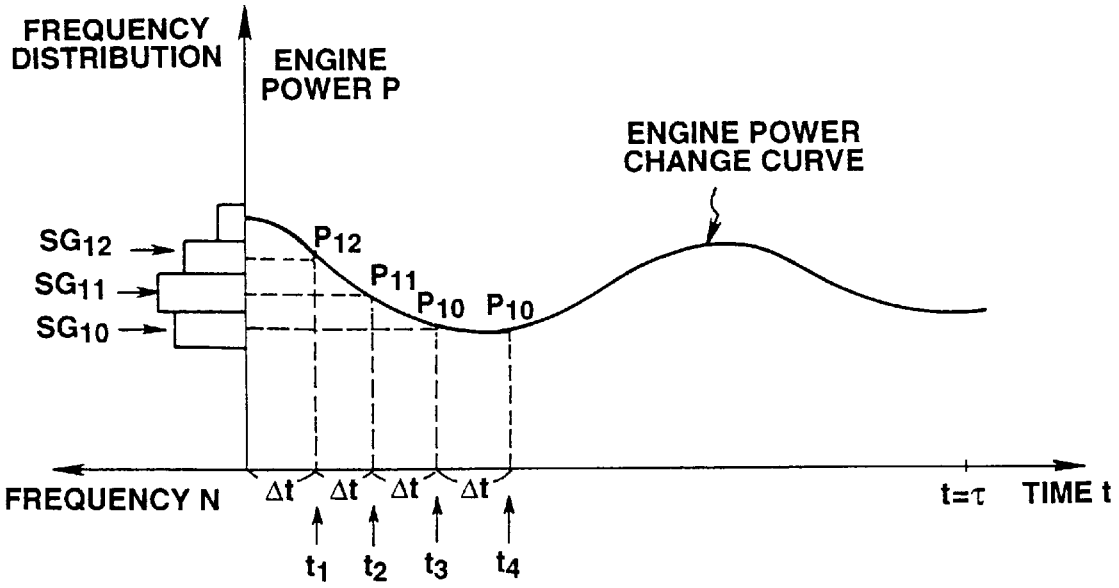
FIG. 4 is a graph illustrating how engine performance changes with the passage of time, employed to explain a frequency distribution.

Referring to FIG. 4, the graph to the right describes how the engine power P varies with the passage of time t, the value P being detected by a prescribed sensor.

Meanwhile, as illustrated in the graph to the left in FIG. 4, a decision is made as to which segment SG the value P detected by the sensor belongs to, and the content of that segment SG to which it belongs is sequentially incremented.

First, at a time t1 after the elapse of Δt, engine power is detected as the value P12, so the contents of the segment SG12 containing this value P12 are incremented by +1. Then, at time t2 after the elapse of another Δt, the engine power is detected as the value P11, so the contents of the segment SG11 containing this value P11 are incremented by +1. Similarly, after that, at time t3 the contents of the segment SG10 corresponding to the engine power P10 are incremented, and at time t4 the contents of the segment SG10 corresponding to the engine power P10 are incremented, by +1, respectively. In this manner, a detection frequency N will be counted for every segment SG, and that detection frequency N is added (step 103).

Next, a decision is made as to whether or not a fixed time τ (24 hours=1 day, for example) has elapsed since the count was started (step 104). If that fixed time τ has not elapsed, then, so long as the engine is operating, the routine described above wherein the detected frequency N is counted and added is repeatedly executed (steps 101 through 103). If, on the other hand, that fixed time τ has elapsed, then the detected frequency N counting routine is terminated for the time being.

FIG. 5 shows a (accumulated) frequency distribution which describes the relationship between the detected frequency count value N (/τ) and the segments SG, after the fixed time τ has elapsed.

Based on the frequency distribution for every fixed time τ, obtained in this manner, it is possible to determine whether the construction machine has suffered a malfunction or other abnormality. An abnormality occurring in the construction machine can be determined, for example, from the peak value in the frequency distribution diagrammed in FIG. 5.

As described in the foregoing, according to this embodiment, instead of sequentially obtaining operating parameter values, detection frequencies N are counted for each segment SG wherein the values of the operating parameters have been divided into multiple levels. Thus the number of the data can be made fewer, and the storage capacity of the memory made smaller.

Further, according to this embodiment, abnormalities in a construction machine are determined by sequentially accumulating frequency distributions for every fixed time τ, as described above.

Figure 6:
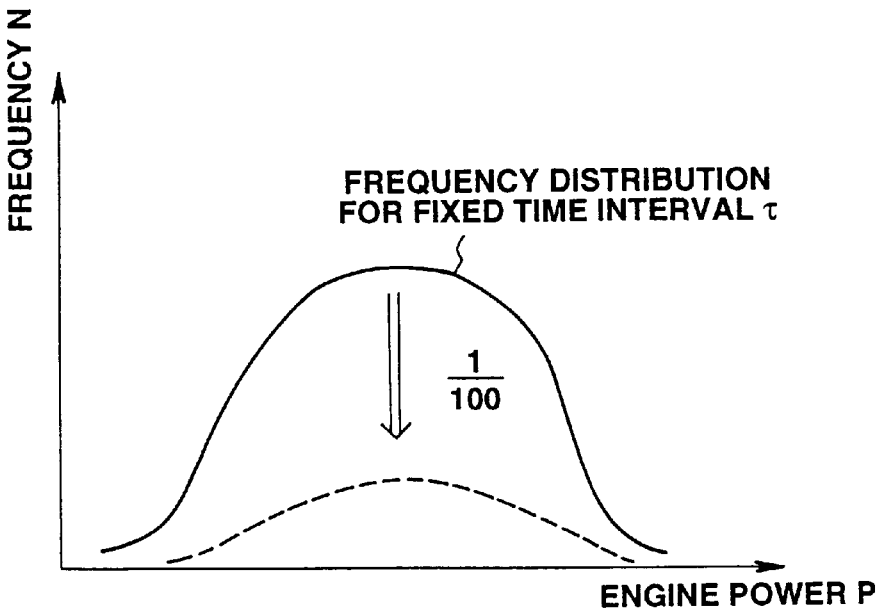
FIG. 6 is a diagram showing how a frequency distribution is scaled (normalized)

More specifically, when a frequency distribution (FIG. 5) is generated anew every fixed time period τ, this frequency distribution needs to be added to the damage accumulation distribution up until that time. For this purpose, as shown in FIG. 6, the frequency N indicated in this newly generated frequency distribution is scale-converted (normalized) to a small value at a fixed ratio (such as 1/100, for example). This scale conversion (normalization) is done to reduce the data volume.

Figure 7:
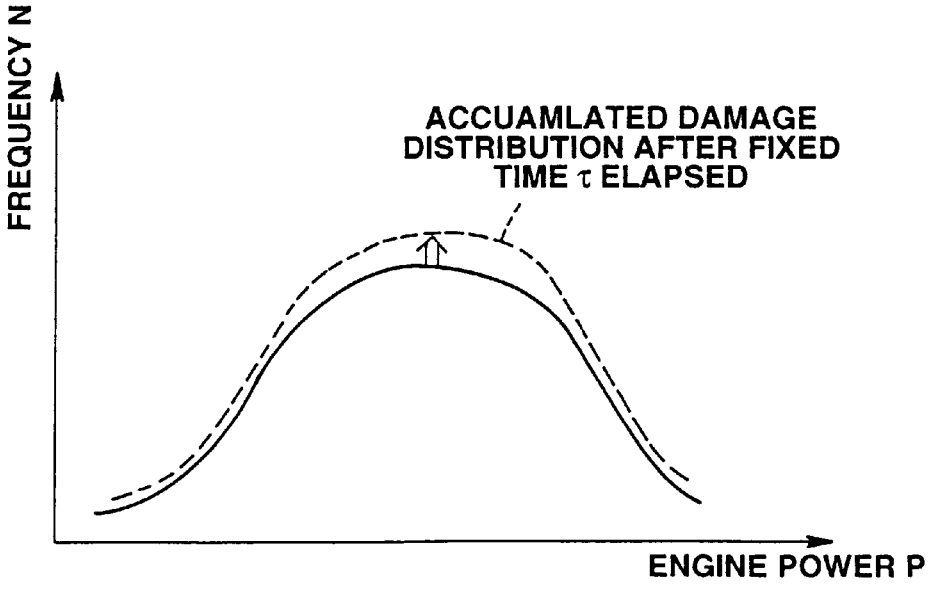
FIG. 7 is a diagram showing how a damage accumulation distribution is generated.

Then, as shown in FIG. 7, the frequency distribution just scale-converted (i.e. the detected frequency of each segment thereof) is added to the damage accumulation distribution (i.e. to the accumulated frequency of each segments thereof) up through the previous time, to generate a new damage accumulation distribution. Δt the time when this addition is made, a correction may be made according to the shape of the damage accumulation distribution up through the previous time.

Abnormalities in the construction machine can be determined on the basis of the damage accumulation distribution generated in this manner. For example, by integrating the damage accumulation distribution, it is possible to quantify the effects which the operating parameter (engine power) has had on the construction machine to that time, and thereby to predict when the construction machine should be overhauled and when its life has been terminated (step 105).

According to this embodiment, abnormalities in the construction machine are determined by pursuing chronological transition in frequency distributions generated for each fixed time $\tau$.

Figure 3:
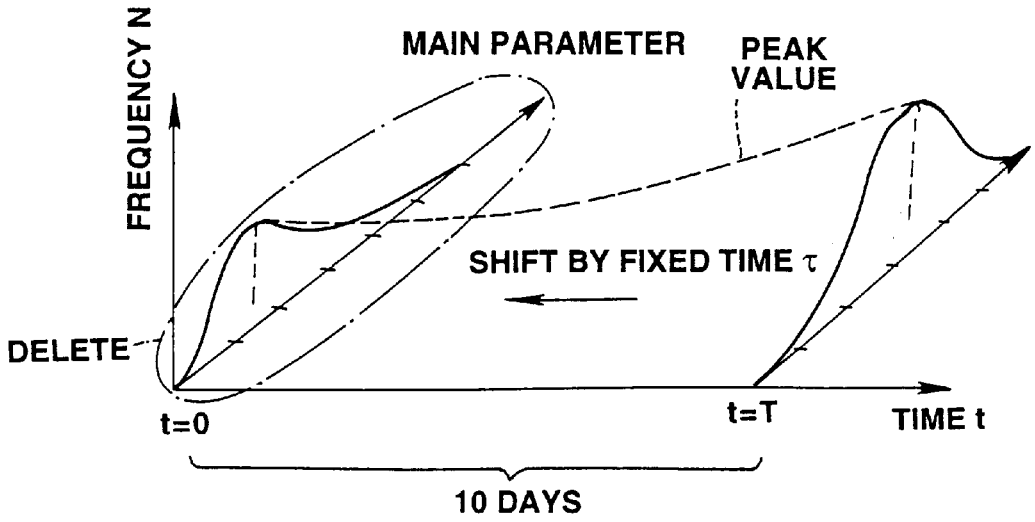
FIG. 3 is a graph illustrating transition in frequency distributions.

That is, as shown in FIG. 3, frequency distributions generated for each fixed time $\tau$ (normalized in step 105) are lined up according to the passage of time, and a transition graph is produced illustrating how these frequency distributions change with the passage of time. When only one operating parameter (engine power) is made the object of detection, the transition graph is produced based on the frequency distribution for that operating parameter. When a set of two or more operating parameters (blow-by pressure, engine rotational speed, rack position) is made the object of detection, the transition graph will be produced on the basis of the frequency distribution of the main parameter (blow-by pressure) among those operating parameters. Alternatively, of course, transition graphs may be produced for all operating parameters.

From the transition graph, it is possible to ascertain changes over time in, for example, peak values in the frequency distributions, and to determine abnormalities in the construction machine from the changes over time in those peak values. Alternatively, construction machine abnormalities may be determined from changes over time in values other than peak values, such, for example, as mean values in the frequency distributions (step 106).

It is also permissible to reverse the order of the routine in step 105 for generating the damage accumulation distributions and the routine in step 106 for producing the transition graph.

When producing the transition graph, in order to reduce data volume, the number of frequency distributions making up the transition graph is limited to some fixed number (10, for example).

For this reason, when a frequency distribution is newly generated, in the transition graph diagrammed in FIG. 3, the newly generated frequency distribution is stored anew in a location corresponding to the current time t=T, and the frequency distribution for the oldest time t=0 (10 days earlier) is deleted from the contents of the memory, as indicated by the dot and dashed line in FIG. 3. The other frequency distributions will all be shifted back by one frequency distribution generation interval (i.e. the fixed time $\tau$ (1 day)).

Thus, the transition graph will always be procured so that it corresponds with the frequency distributions generated over a fixed time period (10 days) up to the present time (step 107).

For the peak values of the frequency distributions, however, the oldest data need not be deleted, so that the entire history (life history) up to the present can be retained intact.

Figure 8:
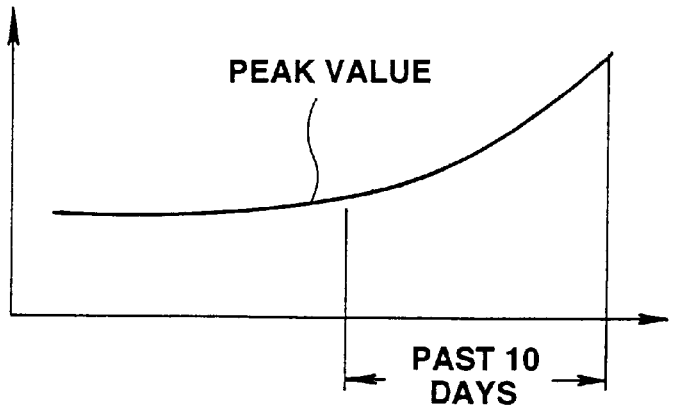
FIG. 8 is a graph illustrating a transition in peak values for the frequency distributions illustrated in FIG. 3.

FIG. 8 is a peak value transition graph illustrating only peak values of frequency distributions extracted from a transition graph. FIG. 8 shows a transition of blow-by pressure peak values, for example.

Abnormalities in the construction machine can be determined from the transition to the present time in these frequency distribution peak values. More specifically, it is possible, for example, to predict when an abnormality (malfunction) will occur in the construction machine from the time that the curve in FIG. 8 begins to rise, and from the gradient at which it rises. Alternatively, it is also permissible, of course, to delete the oldest data for the frequency distribution peak values, and to retain in memory only data for the fixed past time period (10 days) up to the present.

Also, the memory content pertaining to the transition graph is reset when a component of the construction machine associated with the operating parameter (main parameter) indicated in this transition graph is replaced. In the case of a transition graph made up from blow-by pressure frequency distributions, for example, when the equipment in the construction machine associated with blow-by pressure, such as the engine itself, for instance, is replaced, the memory content for this transition graph will be reset.

An embodiment of a method of determining machine maintenance due times based on the above-described machine abnormality monitoring method will now be described.

In this embodiment, it is supposed that the construction machine comprises such components as an engine, transmission, and pumps, etc., and it is further supposed that maintenance due times are to be determined for each of this components. In this embodiment, by maintenance due time is meant the time for a component to be overhauled.

Figure 12:
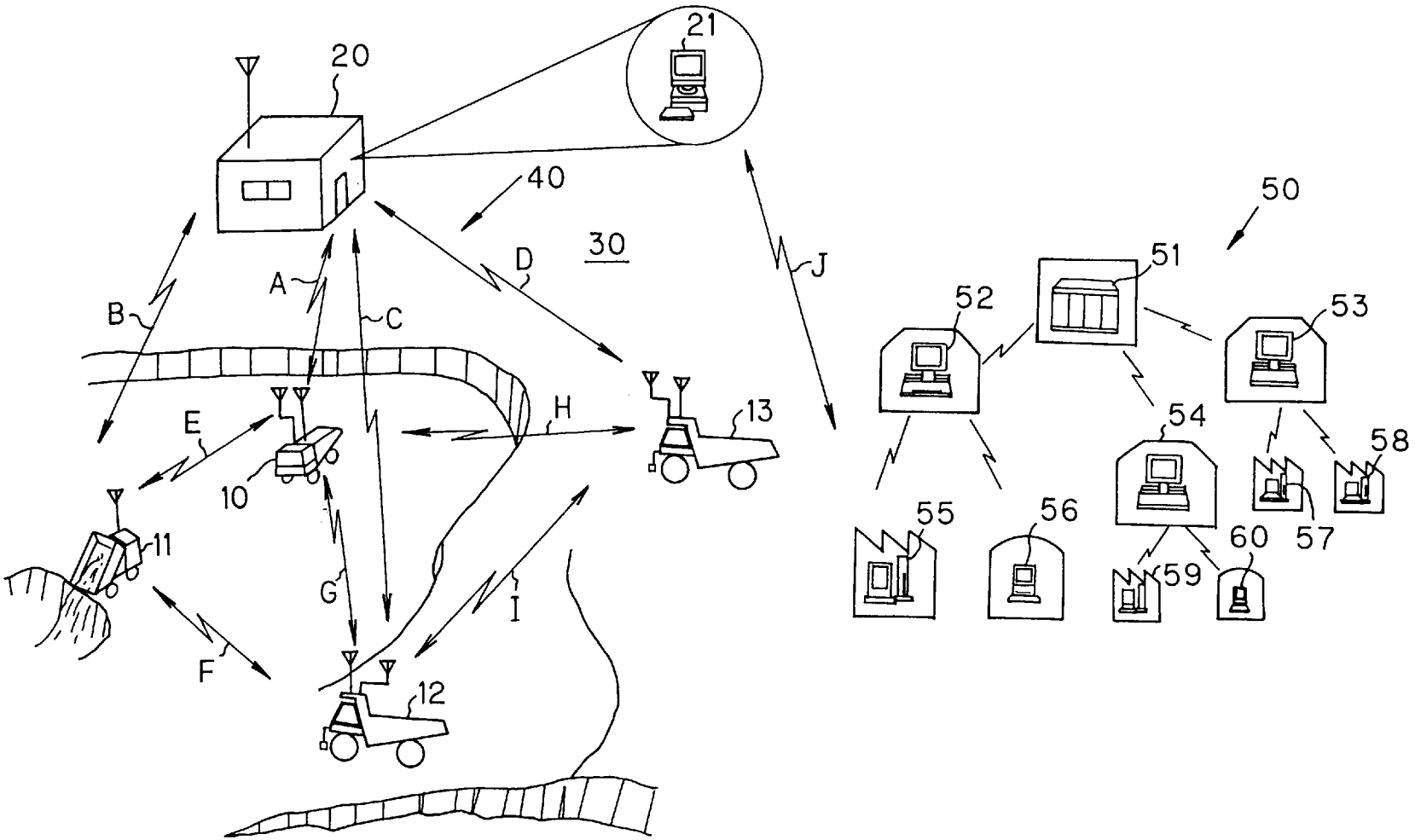
FIG. 12 is a diagram illustrating a communication network in the embodiment.

FIG. 12 shows communication networks 40 and 50 such as are assumed for this embodiment. These communication networks 40 and 50 exchange maintenance information on all of the various kinds of construction machines (dump trucks, wheel loaders, hydraulic shovels, etc.) that are shipped worldwide, being configured for the purpose of providing maintenance information to individual users in the world.

More specifically, as is shown in FIG. 12, these communication networks 40 and 50 are, in macro terms, made up of a field network 40 that is a communication network contained within each construction machine user's work site, and a global network 50 that spans the globe and which is a communication network linking the head offices, sales centers, and factories (parts warehouses, maintenance plants, and assembly plants) of the manufacturers of the construction machines that are dispersed around the world.

The field network 40 in a wide-area work site 30 such as a mining site, serves as an unmanned dump truck monitoring system for monitoring and controlling a plurality of unmanned dump trucks (hereinafter sometimes called vehicles) 10, 11, 12, 13, . . . from a monitoring station 20. In this embodiment, these unmanned dump trucks are supposed as the vehicles inside the work site 30, but, of course, these may be manned vehicles, or machines other than dump trucks, such as wheel loaders or hydraulic shovels.

This unmanned dump truck monitoring system sends and receives data that indicate the positional interrelationship between the vehicles by means of inter-vehicle communication channels E, F, G, H, and I, and also sends and receives, by means of communication channels A, B, C, and D between the vehicles and the monitoring station, data comprising run and stop commands, etc., from the monitoring station 20 to the vehicles 10, 11, . . . , and vehicle data from the vehicles 10, 11, . . . , to the monitoring station 20.

A computer 21 having functions for coordinating the control of the vehicles within the work site 30 is installed in the monitoring station 20. This computer 21 comprises an input device for inputting information pertaining to maintenance (in-house maintenance) performed by the user in the work site 30 as will be described below, and a display device for displaying, to the user in the work site 30, maintenance information such as the remaining life until maintenance due time (remaining hours) for each of the plurality of vehicles 10, 11, . . . , at the work site 30.

Meanwhile, the global network 50 comprises a managing computer 51 that manages and controls maintenance information on all construction machines (vehicles) shipped by construction machine manufacturers throughout the world, computers 52 and 53 of local companies and a computer 54 at a branch office that are subordinate to the managing computer 51, a computer 55 at the construction machine assembly plant (or maintenance plant) and a computer 56 at the parts warehouse that are subordinate to the computer 52, computers 57 and 58 at the construction machine assembly plant (or maintenance plant) that are subordinate to the computer 53, and a computer 59 at the construction machine assembly plant (maintenance plant) and a computer 60 at the parts warehouse that are subordinate to the computer 54.

The configuration furthermore provides bidirectional communication channel J through which communication is conducted, for example, between the computer 55 at the construction machine assembly plant and the computer 21 at the work site 30 to which the construction machine has been shipped from the construction machine assembly plant.

Accordingly, data possessed by the computer 21 at the work site 30 is input to the managing computer 51 by communication channel J and communications via the global network 50, while data possessed by the managing computer 51 is input to the computer 21 at the work site 30, by communication channel J and by communications the global network 50.

The processing performed through these communication networks 40 and 50 will now be described, making reference to the flowcharts given in FIG. 10 and 11.

In the description, the vehicle 10 will be used to represent the vehicles at the work site 30, and the engine will be used to represent the component of the vehicle 10.

Figure 10:
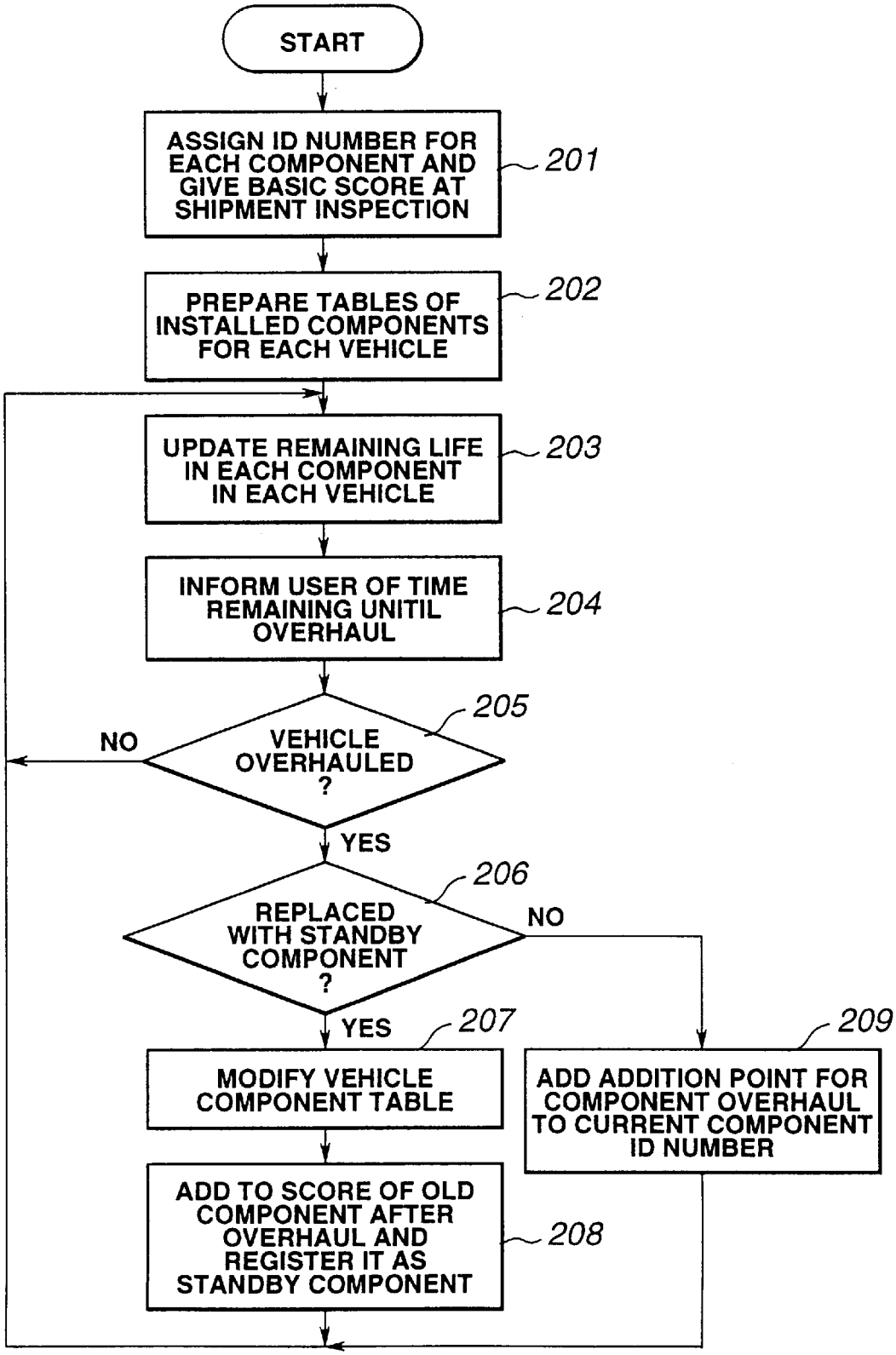
FIG. 10 is a flowchart illustrating a processing routine performed over the global network for an embodiment of a method and apparatus for determining machine maintenance due times of the present invention.
Figure 11:
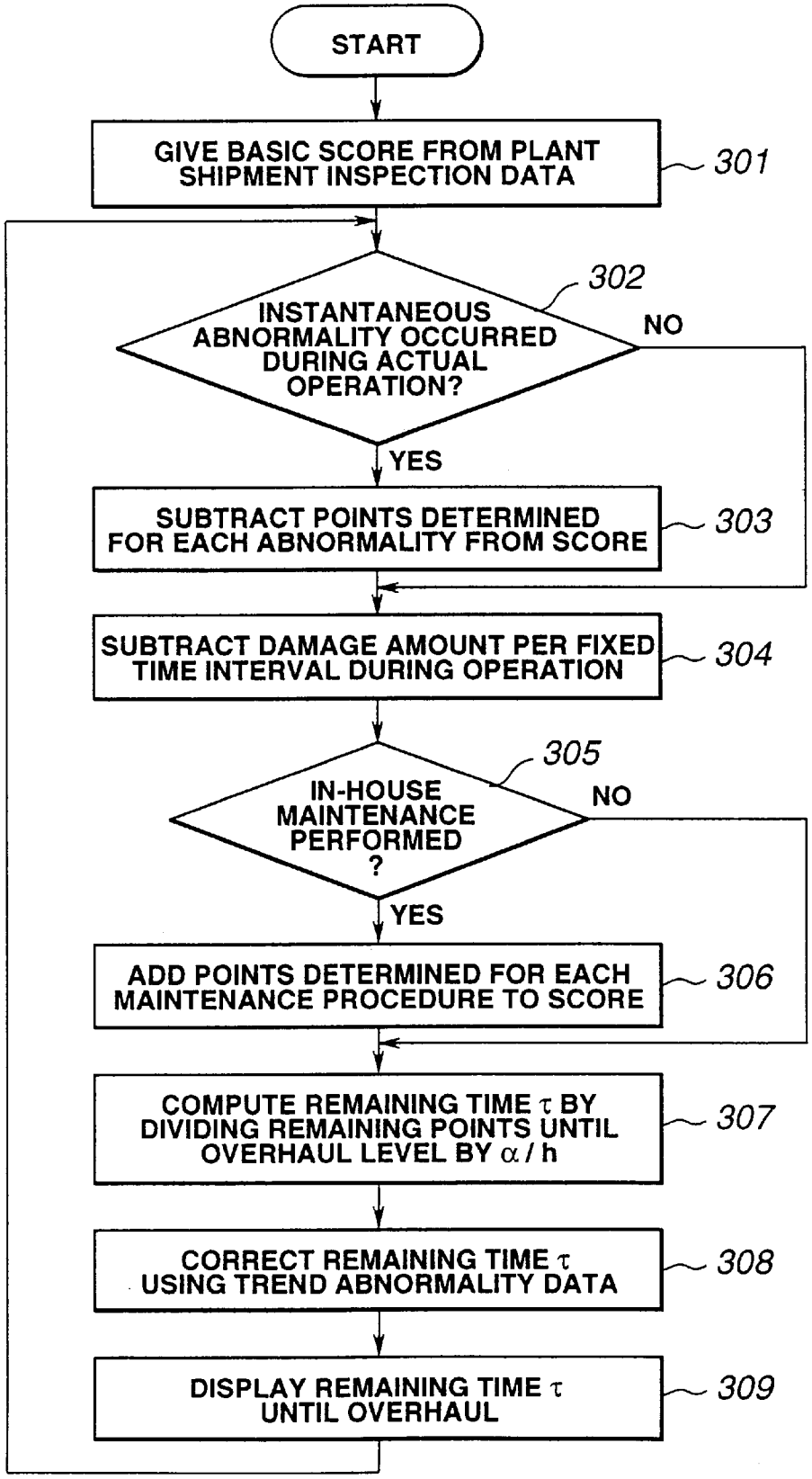
FIG. 11 is a flowchart illustrating a processing routine performed over the field network for the embodiment of the present invention.

FIG. 10 shows processing performed over the global network 50, while FIG. 11 shows processing performed over the field network 40.

First, an ID number is given to each component making up the vehicle for identifying that component, and a basic score is given thereto during the shipping inspection. This basic score for each component is given by the computers 56 and 60 in the parts warehouse that ships the component (step 201).

Next, the ID numbers and basic scores which have been given to each component at the parts warehouses are rearranged for each vehicle by the computers 55, 57, 58, and 59 at the assembly plants that assemble the vehicle. For example, the computer 55 at the assembly plant which assembles and ships the vehicle 10 executes a routine to produce a table from the ID number and basic score of each component to be installed in the vehicle 10.

Specifically, as shown in FIG. 13, a vehicle component table is produced wherein basic scores 80, 85, 70, . . . , are associated with ID numbers #25, #107, #201, . . . , for the components making up the vehicle 10, i.e. the engine, transmission, and pump, . . . , respectively. This vehicle component table is prepared for each vehicle (step 202).

Next, as will be discussed below in conjunction with FIG. 11, each time the remaining life (remaining time) $\tau$ of a component in a vehicle is updated, data representing this remaining time $\tau$ are input to the managing computer 51 (step 203). The managing computer 51 then instructs to inform each user of that remaining time $\tau$ (step 204).

Steps 203 and 204 are described more specifically in FIG. 11.

That is, the basic score is given to each component configuring the vehicle 10 when vehicle 10 is shipped from the plant, as is indicated in the vehicle component table in FIG. 13. The basic score is the initial score Sc indicating the reserve time from the time the component left the plant until its first maintenance due time. Even components that are of the same kind (engines, for example) have individual differences, and so the score Sc of these components of the same kind may differ depending on the results of the inspection at the time of shipment from the plant. The content of this vehicle component table (FIG. 13) for the vehicle 10 is input from the assembly plant computer 55 by communication channel J to the computer 21 at the work site 30 (step 301).

Now, a subtraction point table is produced by the computer 21, as tabulated in FIG. 14, wherein a point to be subtracted from the score Sc of each component in the vehicle 10 are given to each of the abnormalities that may occur while the vehicle 10 is operating, such as overheating, drop in oil pressure, overloading, etc.

The subtraction points in this subtraction point table are set such that their absolute values are larger the more extensive is the damage imparted to the component. The subtraction point table is prepared for each vehicle. Alternatively, one common table may be prepared for all of the vehicles.

Also, as shown in FIG. 15, an addition point table is prepared by the computer 21 wherein point to be added to the score Sc of each component is given to each maintenance such as overhaul, piston replacement, engine oil filter replacement which is performed on the vehicle 10. The cores in this addition point table are set so as to have larger values the greater the degree of component restoration. This addition point table may be prepared for each vehicle, or, alternatively, a common table may be prepared for all vehicles.

The vehicle 10 is equipped with various sensors for detecting the occurrence of such abnormalities as overheating, a drop in oil pressure, or overloading, etc., as noted above. For example, a temperature sensor that detects the temperature of the engine cooling water may be installed in the vehicle 10 so that, when the temperature rises above a designated threshold value indicating overheating, overheating is judged to have occurred. Such abnormalities that are determined by various sensors are called instantaneous abnormalities, because they are abnormalities that, in terms of time, occur for short periods. This is done to distinguish them from trend abnormalities that develop gradually over a longer period of time (which will be discussed subsequently).

In this manner, it is possible to determine whether or not the instantaneous abnormality of, for example, overheating has occurred in the component that is the engine, by the value detected by the temperature sensor (step 302).

When it is determined, by the temperature sensor, that the instantaneous abnormality of overheating has occurred in the engine in the vehicle 10 (YES in step 302), the subtraction point S− (20 points) associated with this detected instantaneous abnormality (overheating) is read out from the subtraction point table in FIG. 14, and a routine is executed to subtract this subtraction point S− from the engine's score Sc. The initial value SO for the engine's score Sc (80 points) is indicated in the vehicle component table in FIG. 13 as basic score.

Figure 17:
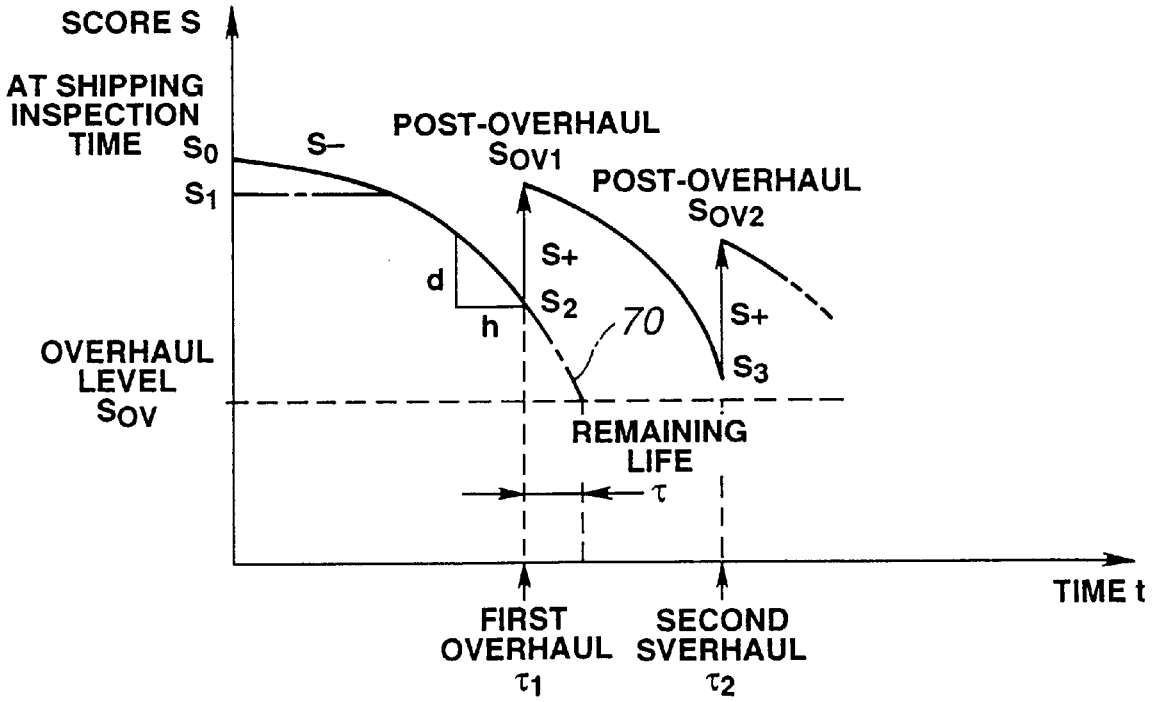
FIG. 17 is a graph showing how the score for the engine in a construction machine changes with the passage of time.

As a result, the engine's score Sc, as shown in FIG. 17, are reduced, down from the initial value SO (basic score) by the amount of the subtraction point S−, and changed to the score S1 (step 303).

Also, a damage amount U per fixed time while the vehicle 10 is operating is subtracted from the current score Sc.

Figure 16:
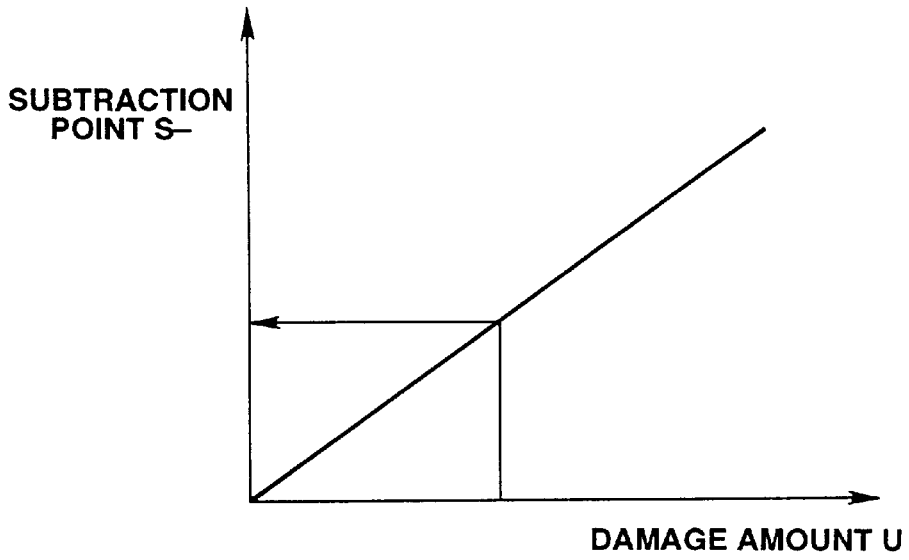
FIG. 16 is a graph illustrating the relationship between damage sustained and subtraction points.

The damage amount U per fixed time while the vehicle 10 is operating is obtained by integrating the frequency distribution per fixed time (1 day) indicated in FIG. 5, as discussed earlier. The frequency distribution plotted in FIG. 5 represents a frequency distribution for the engine power P per day. By integrating this frequency distribution for engine power P, the amount of damage U sustained in the fixed time period (1 day) by the engine in the vehicle 10 can be found. This damage amount U is converted to a subtraction point S− in accordance with the graph plotted in FIG. 16.

Thus a subtraction point S− corresponding to the damage amount U will be subtracted from the current engine's score Sc. Some parameter other than engine power may be used for the engine damage amount U so long as it is a parameter affecting the engine (step 304).

Next, a determination is ordinarily made as to whether or not the user has performed maintenance (in-house maintenance). Specifically, every time the user performs in-house maintenance, such as an overhaul or replacing consumable engine parts (such as the engine oil filter), data indicating maintenance information to that effect are input to the computer 21.

As a result, when the maintenance information is input, an addition point S+ associated with the type of maintenance indicated in the input maintenance information is added to the current score Sc of the corresponding component in the vehicle 10. When, for example, maintenance information indicating that the user has performed the maintenance of changing the oil filter in the vehicle 10 is input (YES in step 305), then, based on the contents of the addition point table given in FIG. 15, an addition point S+ (5 points) associated with this input maintenance information (filter change) is read out, and a routine is executed to add this addition point S+ to the engine's score Sc (step 306).

Thus, as described in the foregoing, the engine's score Sc in the vehicle 10 is sequentially changed while the vehicle 10 is being operated, from the initial value of the basic score given at factory shipment, by undergoing reductions by subtraction points S− and additions by addition points S+. When the value resulting from such additions and subtractions in the engine's score Sc reaches the overhaul level Sov (10 points, for example) indicating time for maintenance (overhaul due) in FIG. 17, it can be determined that it is time for engine maintenance. The fact that this maintenance due time has been reached is displayed on the screen of the display device for the computer 21. By this means, the user will know to overhaul the engine in the vehicle 10 at the proper time.

In this embodiment, moreover, forecasts are made continually, during the operation of the vehicle 10, as to the remaining life (remaining time) $\tau$ from the present time until a maintenance due time for the engine will be reached. The forecasted remaining time $\tau$ is displayed on the display screen for the computer 21.

Specifically, referring to FIG. 17, if it be assumed that the engine operating time in the vehicle 10 is currently $\tau 1$, then, based on the engine's score S2 at this current time $\tau 1$, on any change per unit time $\alpha$/h in the score of the engine at this present time $\tau 1$, and on the score Sov corresponding to the maintenance due time for this engine, the remaining time $\tau$ from the current time $\tau 1$ to the maintenance due time $\tau$ for the engine is calculated using Formula (1) below (step 307).

$$\tau=(S2-Sov)\times h/\alpha \quad (1)$$

Although this forecast time $\tau$ computed in step 307 may be displayed without modification on the display screen for the computer 21, but, in this embodiment, it is first corrected on the basis of trend abnormality data.

The trend abnormality data is a data which indicates trends of changes in values of operating parameters that occur gradually while the vehicle 10 is being operated.

Figure 18:
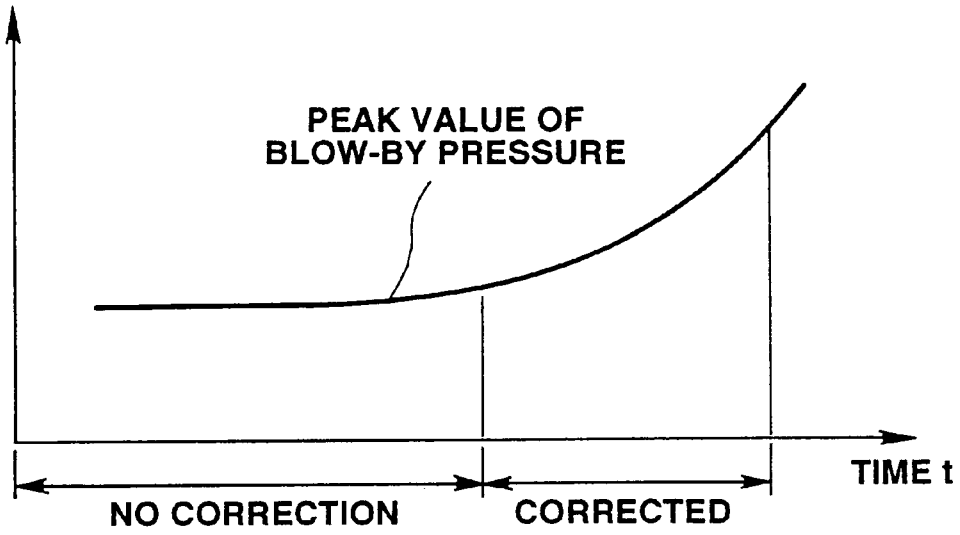
FIG. 18 is a diagram illustrating the interval in a peak value transition graph wherein remaining time should be corrected and the interval wherein no correction should be made.

More specifically, as discussed earlier, the peak value transition graph for blow-by pressure plotted in FIG. 8 is divided into two segments; a segment showing a tendency for abnormalities to occur, and a segment showing no tendency for abnormalities to occur, as shown in FIG. 18. In the segment showing no tendency for abnormalities to occur, no correction is made in the remaining time $\tau$, and in the segment showing a tendency for abnormalities to occur, correction is made in the remaining time $\tau$.

Figure 19:
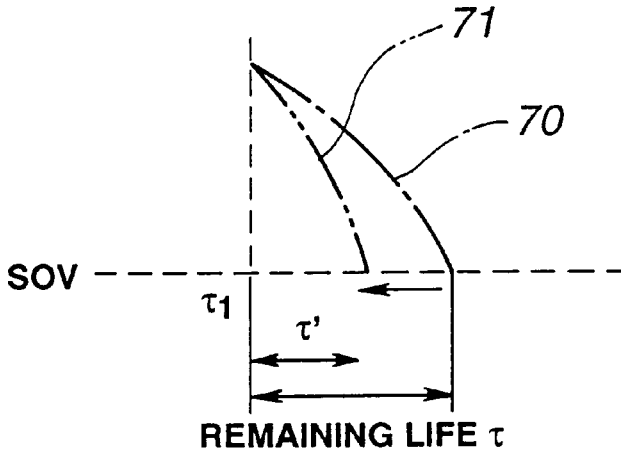
FIG. 19 is a diagram used in describing how remaining time is corrected.

Referring to FIG. 19, when, at the current time $\tau 1$, the peak value transition graph falls within the segment wherein corrections should be made, the remaining time $\tau$ computed in step 307 is corrected to a shorter remaining time $\tau'$. That is, when a trend abnormality occurs, the falling curve 70 for the score Sc in FIG. 17 is corrected to a more sharply falling curve 71 so that the maintenance due time is made sooner. As far as the peak value transition graph is concerned, however, a graph that represents the peak value transition in a parameter other than the blow-by pressure may be used so long as it is a parameter that affects the engine (step 308).

In this manner, the corrected forecast remaining time $\tau'$ for engine maintenance will be displayed on the display screen for the computer 21. As a result, the user will see the forecast remaining time $\tau'$ on the screen and will know beforehand when maintenance should be performed (step 309). When the user learns at time $\tau 1$ that the forecast remaining time before overhaul is due is $\tau'$, the user performs the overhaul on the engine in vehicle 10 at that time and inputs maintenance information to the effect that overhaul maintenance has been performed (YES in step 305). Based on the contents of the addition point table given in FIG. 15, an addition point S+ (50 points) associated with the input maintenance information (overhaul) is read out, and a routine is executed for adding this addition point S+ to the current score S2 for the engine. As a result, the engine's score Sc will rise to Sov1, as represented in FIG. 17, whereupon the reserve time until the next maintenance due time (overhaul time) will be increased, that is, the engine's remaining time $\tau$ will be updated (step 306).

Thus, each time the remaining time $\tau$ for a component of the vehicle is updated, data representing that remaining time $\tau$ is input to the managing computer 51 by communication channel J and via the global network 50 (step 203). Then, the managing computer 51 instructs to inform the users of this remaining time $\tau$ by communication channel J and via communications over the global network 50, as a result of which the remaining time $\tau$ will be displayed on the display screen of the computer 21 at each user (step 204).

In addition, data carrying maintenance information as to whether each component in each vehicle has been overhauled or not are input to the managing computer 51 via the communication networks 40 and 50.

In other words, maintenance information to the effect that the user has performed an overhaul on the engine in-house, and that the engine was at the time of overhaul replaced by a standby component (spare engine), is input from the computer 21 to the managing computer 51 by communication channel J via the global network 50. Also, when an engine is overhauled at a maintenance plant, maintenance information to the effect that the engine was overhauled at the maintenance plant and that, at the time of this overhaul, the engine was replaced by a standby component, is input by an input device for the computer 55 at the maintenance plant, and input to the managing computer 51 via the global network 50.

In the managing computer 51, based on data representing the input maintenance information, a routine continually determines whether every component of every vehicle has been overhauled or not (step 205).

Additionally, in the managing computer 51, based on data representing the input maintenance information, a routine continually determines whether every component of every vehicle has been replaced by a standby component or not (step 206).

As a result, when it is determined for the engine of the vehicle 10 first that an overhaul has been performed (YES in step 205) and then that a replacement has been made by a standby component at the time of overhaul (step 206 decision is Yes), an addition point S+ corresponding to the overhaul is added to the current score Sc for the engine (ID number #25; see FIG. 13). In other words, based on the contents of the addition point table in FIG. 15, an addition point S+ (50 points) associated with the overhaul is read out, and a routine is executed for adding the addition point S+ to the score S3 of the engine at the current time $\tau$2 (step 209). As a result, as shown in FIG. 17, the engine's score is increased to Sov2, and the reserve time until the next maintenance due time (overhaul time) is increased, that is, the engine's remaining time $\tau$ is updated (step 203).

Meanwhile, when it is determined first that an overhaul has been performed on the engine in vehicle 10 (YES in step 205), and then that a replacement was made with a standby component at the time of overhaul (YES in step 206), a routine is executed to rewrite the contents of the vehicle component table for the vehicle 10 in which the standby component was installed.

More specifically, in the vehicle component table given in FIG. 13, the engine ID number (#25) prior to replacement by the standby component is rewritten to reflect the ID number (#37, for example) of the standby component (spare engine). Also, the basic score (80 points) of the engine before replacement is rewritten to reflect the basic score (75 points, for example) associated with the standby component (#37) (step 207).

Further, since the engine prior to replacement (ID number #25) is being overhauled, an addition point corresponding to the overhaul is added to the score Sc of that engine. More specifically, based on the contents of the addition point table in FIG. 15, an addition point S+ (50 points) associated with the overhaul is read out, and a routine is executed for adding that addition point S+ to the score S3 of that engine at the current time $\tau$2. As a result, as indicated in FIG. 17, the score of that engine are increased to Sov2. Then that engine (#25) will be registered as a "standby component" having the post-overhaul score Sov2. This standby component registration is performed by the computer 56 at the parts warehouse which supplies the standby component to the vehicle 10 and takes in the component removed from vehicle 10. These results are input to the managing computer 51 via communication channels over the global network 50.

For the subtraction points and addition points for the standby component (#37) installed in the vehicle 10, the values of the subtraction and addition points for the pre-replacement engine (#25) may be used without modification, as indicated in the subtraction point table in FIG. 14 and the addition point table in FIG. 15. Alternatively, when the engine in the vehicle 10 is replaced by the standby component (#37), the contents of the subtraction point table in FIG. 14 and the addition point table in FIG. 15 may be rewritten (step 208).

As described in the foregoing, when this embodiment is employed, depending on the status of in-house maintenance such as filter replacement and overhaul performed by the user, the score Sc of the engine component in the vehicle 10 are added to, and, depending on the occurrence of such abnormalities during the operation of the vehicle 10 as overheating, loss of oil pressure, or overloading, etc., the score Sc of the engine are subtracted from, thus changing the engine's score Sc. Therefore it is possible to determine maintenance due times by comparing the engine's score Sc so added to and subtracted from against the score Sov corresponding to the maintenance due time (overhaul time), and thus to appropriately determine when to perform maintenance. In other words, the user will not be obliged to perform unnecessary maintenance due to a maintenance due time being determined too early, nor will serious damage be done to the vehicle for reason of a maintenance due time being determined too late.

Furthermore, according to this embodiment, the ID number #25 is given to an engine that is one of the components (inclusive of standby components) in the vehicle 10, as an identifying code designating that engine specifically, and scores are associated with that ID number #25, namely score Sc (basic score) of 80 points, subtraction points (−20 points, −10 points, −50 points: ebb. FIG. 14) for occurrences of abnormalities such as overheating, and addition points (+50 points, +10 points, +5 points) for when maintenance operations such as overhauls are performed. Thus, even when a maintenance due time is reached, and the engine in the vehicle 10 is replaced by a standby component, ID number #37 as an identifying code is given to that standby component also, and codes are associated with that ID number #37, namely score of 75 points, subtraction points for cases where an abnormality such as overheating occurs (ebb. content of subtraction point table in FIG. 14), and addition points for when maintenance such as overhaul is performed (ebb. content of addition point table in FIG. 15). It is therefore possible to appropriately determine the next maintenance due time (overhaul time) after the replacement by the standby component, just as before that replacement. In other words, even when the engine component in the vehicle 10 has been replaced, it is possible to appropriately determine the next maintenance due time with continuity.

This embodiment has been described in terms of application to the components that configure a vehicle, but the present invention may also be applied at the parts level, subdividing the components. In other words, the present invention may be freely applied at the user's discretion, so long as components configuring a machine are in view.

What is claimed is:

1. A method of determining maintenance due times for a machine on the basis of the operating status, comprising the steps of:

giving a score according to reserve time remaining until next maintenance due time to each component of the machine;

associating a point to be subtracted from a score of each the component of the machine, for every type of abnormal phenomenon that could occur while the machine is operating, and for associating a point to be added to the score of each the component of the machine for every type of maintenance that would be performed on the machine;

detecting abnormal phenomena that occurred while the machine is operating, and inputting information on maintenance that was performed on the machine;

subtracting a subtraction point associated with the detected abnormal phenomena from the score of the corresponding component of the machine, and for adding an addition point associated with maintenance type indicated by the maintenance information to the score of the corresponding component of the machine; and determining that the maintenance due time for the component has been reached when value resulting from subtraction from or addition to the score for the component of the machine attains a prescribed value.

2. The method of determining maintenance due times for a machine according to claim 1, further comprising a step of collecting data on operating parameters having values that change during machine operation, and for ascertaining trend in changes in the values of the operating parameters, wherein in the step of determining that the maintenance due time has been reached, the maintenance due time of the component is corrected according to the trend in changes in the values of the operating parameters.

3. The method of determining maintenance due times for a machine according to claim 1, further comprising a step of computing remaining time for components of the machine, from current time until maintenance due time, based on a score at a current time, on amount of change per unit time in the score at current time for the components, and on a score corresponding to maintenance due time for the components.

4. The method of determining maintenance due times for a machine according to claim 1, wherein an identification code that specifies a component of the machine is given to each component of the machine, and the identification code are associated with the score, subtraction points when abnormalities have occurred, and addition points when maintenance has been performed.

5. A apparatus of determining maintenance due times for a machine on the basis of its operating status, comprising:

first memory means for storing a score according to reserve time remaining until next maintenance due time for each component of the machine;

second memory means for storing points to be subtracted from the score of each the component of the machine, the points to be subtracted being associated with each type of abnormal phenomenon that could occur while the machine is operating, and points to be added to the score of each the component of the machine, the points to be added being associated with each type of maintenance that would be performed on the machine;

abnormality detection means for detecting abnormal phenomena that occurred while the machine is operating;

input means for inputting information on maintenance that was performed on the machine;

score computation means for subtracting a subtraction point associated with the detected abnormal phenomena from the score of the corresponding component of the machine, and for adding an addition point associated with maintenance type indicated by maintenance information to the score of the corresponding component of the machine; and determination means for determining that the maintenance due time for a component has been reached when value resulting from subtraction from or addition to the score for the component of the machine attains a prescribed value.

6. The apparatus of determining maintenance due times for a machine according to claim 5, further comprising trend computation means for collecting data on operating parameters having values that change during machine operation and for computing trend in changes in the values of the operating parameters, wherein the determination means corrects the maintenance due time of the component according to the trend in changes in the values of the operating parameters computed by the trend computation means.

7. The apparatus of determining maintenance due times for a machine according to claim 5, further comprising remaining time computation means for computing remaining time for components of the machine, from current time until maintenance due time, based on the score at current time of the components, on amount of change per unit time in score at current time for the components, and on a score corresponding to maintenance due time for the components.

8. The apparatus of determining maintenance due times for a machine according to claim 5, wherein an identification code that specifies a component is given to each component of the machine, and the second storage means stores scores, subtraction points when the abnormalities have occurred and addition points when the maintenance has been performed, associated with the identification code for each the component of the machine.

* * * * *